US006508683B1

(12) United States Patent
Garcia

(10) Patent No.: US 6,508,683 B1
(45) Date of Patent: Jan. 21, 2003

(54) LINE THROWING DEVICE

(76) Inventor: Teddy Garcia, P.O. Box 1717, Orange Park, FL (US) 32067

( * ) Notice: Subject to any disclaimer, the term of this patent is extended or adjusted under 35 U.S.C. 154(b) by 0 days.

(21) Appl. No.: 09/952,530

(22) Filed: Sep. 14, 2001

(51) Int. Cl.[7] ..... B63C 9/26
(52) U.S. Cl. ..... 441/84; 441/80
(58) Field of Search ..... 441/1, 80, 81, 441/84, 85

(56) References Cited

U.S. PATENT DOCUMENTS

| | | | | |
|---|---|---|---|---|
| 2,025,995 A | | 12/1935 | Lerch | |
| 2,029,790 A | | 2/1936 | Philipp | |
| 2,192,203 A | | 3/1940 | Purdy | |
| 2,685,283 A | | 8/1954 | Bucklin | |
| 3,115,129 A | | 12/1963 | Merriman | |
| 3,676,882 A | | 7/1972 | Lindqvist | |
| 3,716,164 A | * | 2/1973 | Fennema | 220/377 |
| 4,302,017 A | | 11/1981 | Huqueriza | |
| 4,713,033 A | | 12/1987 | Cameron | |
| 4,926,780 A | | 5/1990 | Wiehagen | |
| 5,562,512 A | | 10/1996 | Samelian | |

FOREIGN PATENT DOCUMENTS

| | | | | |
|---|---|---|---|---|
| GB | 02179599 | * | 3/1987 | 441/84 |

* cited by examiner

*Primary Examiner*—Stephen Avila
(74) *Attorney, Agent, or Firm*—Thomas C. Saitta

(57) ABSTRACT

A line throwing device having a throwing basket mounted onto a handle, the throwing basket retaining a float and line, where the throwing basket is provided with a slot extending from the open end of the throwing body toward the handle, such that the line extends through the slot for rapid retrieval and subsequent throw of a thrown float, and where the slot also provides for drainage of the device.

13 Claims, 3 Drawing Sheets

LINE THROWING DEVICE

BACKGROUND OF THE INVENTION

This invention relates generally to the field of line throwing or rescue devices, and more particularly to such devices which are handheld and have no additional mechanically assisted or powered propulsion mechanisms beyond the flinging arm motion of the user.

In many circumstances, and particularly in many marine circumstances, it is desired or necessary to project a line or an object tethered to a line a significant distance with a fair degree of accuracy. For example, in rescue situations where a person goes overboard, the ability to quickly deliver a line or a tethered float to the person in the water may be a matter of life or death. Similarly, but in less dire circumstances, it is often desirable to deliver a tow line or docking line to another boat or to a dock while the user is still a significant distance from the receiver.

A number of devices have been developed to address these circumstances. Some devices incorporate propulsion mechanisms, such as compressed air, springs, etc. Example of handheld throwing devices include U.S. Pat. No. 2,192,203, issued in 1938 to Purdy, which discloses a tethered float maintained in a case, where the float is removed from the case and thrown, with the line allowed to play off a spindle. U.S. Pat. No. 3,676,882, issued in 1972 to Lindqvist, shows a bag which contains a float, weight and line. The end of the line is grasped or secured and the entire bag is tossed into the water, the line playing out from the bag. U.S. Pat. No. 4,713,033, issued in 1987 to Cameron, shows another version of a throw bag. U.S. Pat. No. 5,562,512, issued in 1996 to Samelian, shows an aerodynamically designed ring having line wrapped around its body in spool-like fashion, where the line unwinds as the ring is thrown in a spinning manner. U.S. Pat. No. 2,685,283, issued in 1951 to Bucklin, shows a plug casting toy incorporating a handle and spool, where the plug is cast in the manner of a fishing lure. U.S. Pat. No. 2,025,995, issued in 1934 to Lerch, U.S. Pat. No. 2,029,790, issued in 1936 to Philipp, U.S. Pat. No. 3,115,129, issued in 1963 to Merriman, and U.S. Pat. No. 4,302,017, issued in 1981 to Huqueriza, all show ball throwing and catching scoops in the nature of a jai-alai cesta. Finally, U.S. Pat. No. 4,926,780, issued in 1990 to Wiehagen, shows a sea anchor deployment device where the tethered parachute-like sea anchor is retained in a housing to which is attached a handle, where the sea anchor is deployed by flinging the housing forward in a throwing motion. These devices all lack structure which increases the accuracy of the throwing device, which allows for rapid retrieval of an errant throw and which allows for drainage of the device after use.

It is an object of this invention to provide a line throwing device for manually delivering a line or a tethered object, such as a float, a significant distance with a high degree of accuracy. It is a further object to provide such a device where no added or powered propulsion mechanisms are required to accomplish these objectives, such that a flinging arm motion by the thrower is sufficient to deliver the object or line the desired distance and with the desired accuracy. It is a further object to provide such a device where line retrieval and a subsequent throw in the case of a first unsuccessful throw is rapidly accomplished. It is a further object to provide such a device where the device is readily storable for easy access and is storable in a manner such that water will drain from the device for rapid drying. The structures inherent for accomplishment of these objects and other objects of the device not specifically expressed will become apparent from the disclosure to follow.

SUMMARY OF THE INVENTION

In general, the invention is a line throwing or tethered object throwing device comprising in conjunction a generally rod-like handle of a size and shape suitable to allow for a secure grip within the line thrower's hand, the handle being attached to a hollow, generally elongated throwing housing or basket member open at the end opposite the handle, a throwing line or tether having one end connected to the handle and the other end connected to a float or other weighted object, the open end and the interior of the throwing basket being sufficient in size to receive the float member and a significant length of line there within. A slot extends longitudinally from the open end of the throwing basket toward the handle and is of sufficient width such that the throwing line can pass through relatively unimpeded. The float is preferably a generally elongated cylindrical object with generally rounded ends, with the throwing line connected to one such end. The open end of the throwing basket is preferably formed with a throwing guide or lip which curves slightly toward the central longitudinal axis of the throwing basket, such that the throwing basket is significantly shorter on one side than the other. A cover or cap member is provided for when the device is stored, the cover retaining the float and line within the throwing basket while allowing water to drain through the uncovered lower portion of the slot.

To utilize the device the cover is removed from the throwing housing to expose the open end of the throwing basket. The user grasps the handle such that the throwing guide is positioned to the rear of the thrower when the device is raised overhead in the throwing motion. The throwing basket is brought back with a generally extended arm, then rapidly whipped forward in the desired throwing direction to propel the float and line from the basket, with the forearm and central axis of the throwing housing ending up pointed in the desired throwing direction, in a manner similar to throwing a baseball or football. If the first throw is unsuccessful in reaching the target, such as a struggling swimmer, the line is rapidly retrieved in large increments with the thrower's free hand by pulling the line through the slot until the float is retrieved into the throwing housing. The float can then be immediately thrown again without requiring that the full line length be reinserted into the throwing basket. After use the wet line and float are loaded back into housing and the handle is thrust into a rod holder or other upright receptacle. Even with the cover in place, water is able to drain from the interior of the throwing basket so that the float and line will dry.

DETAILED DESCRIPTION OF THE INVENTION

With reference to the drawings, the invention will now be described in detail with regard for the preferred embodiment and best mode. In general, the invention is a handheld line throwing or tethered object throwing device, where the tethered object may comprise a float or other weighted object to provide mass to the end of the line, where the propulsion of the line and tethered object is accomplished solely through a throwing or flinging motion without additional or powered propulsion means. While the invention is mainly directed toward marine or nautical applications, it is to be understood that the invention may be utilized in non-marine environments as well. As used herein, the terms "line throwing device" shall be taken to include both a device which utilizes a weighted member to provide mass to deliver the line to a distant location as well as a device for delivering an object to a distant location, where the object delivered is connected to a line for retrieval purposes.

Figure 1:
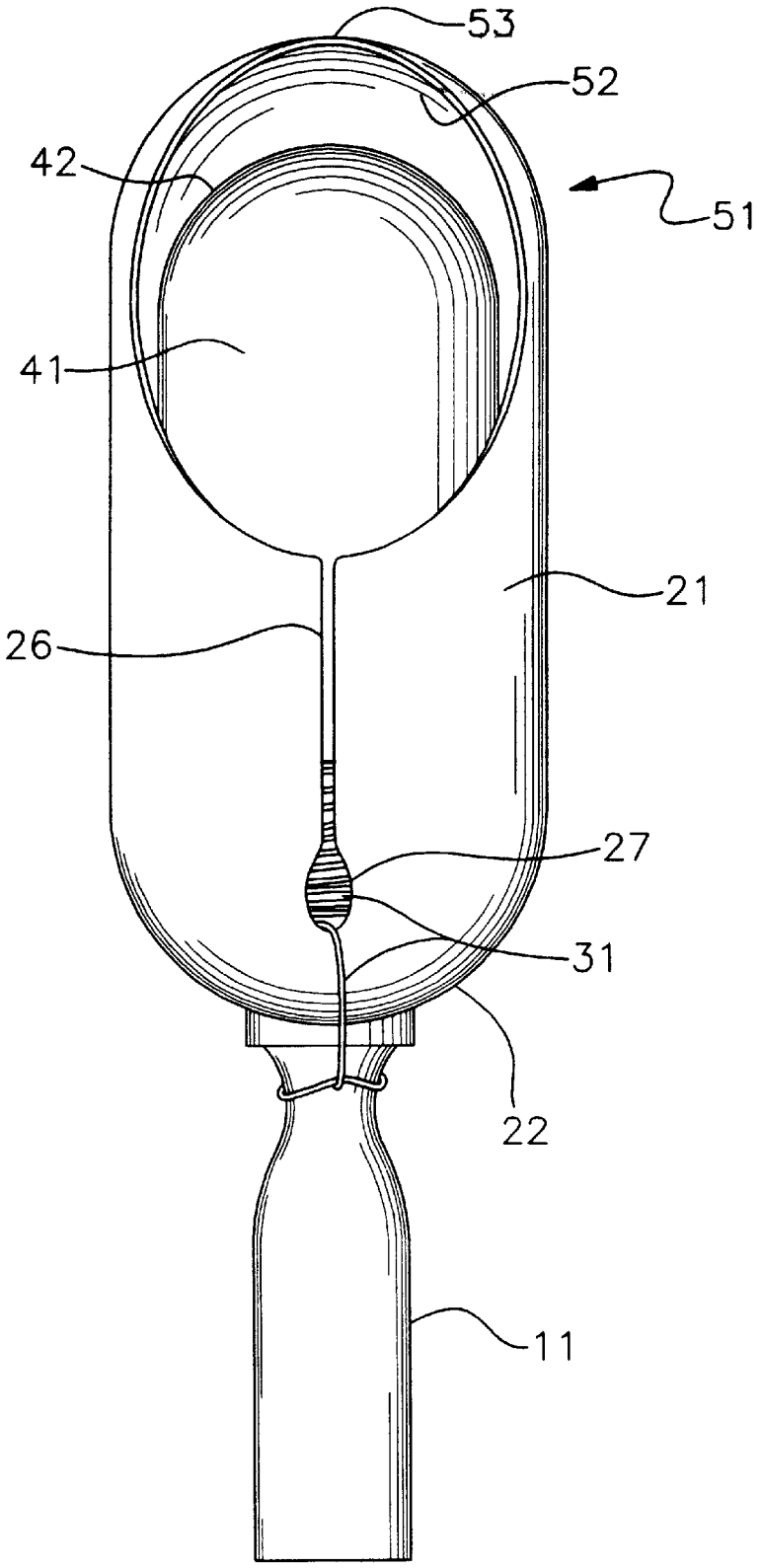
FIG. 1 is a front view of the invention showing the float member and line as disposed within the throwing basket prior to use.
Figure 2:
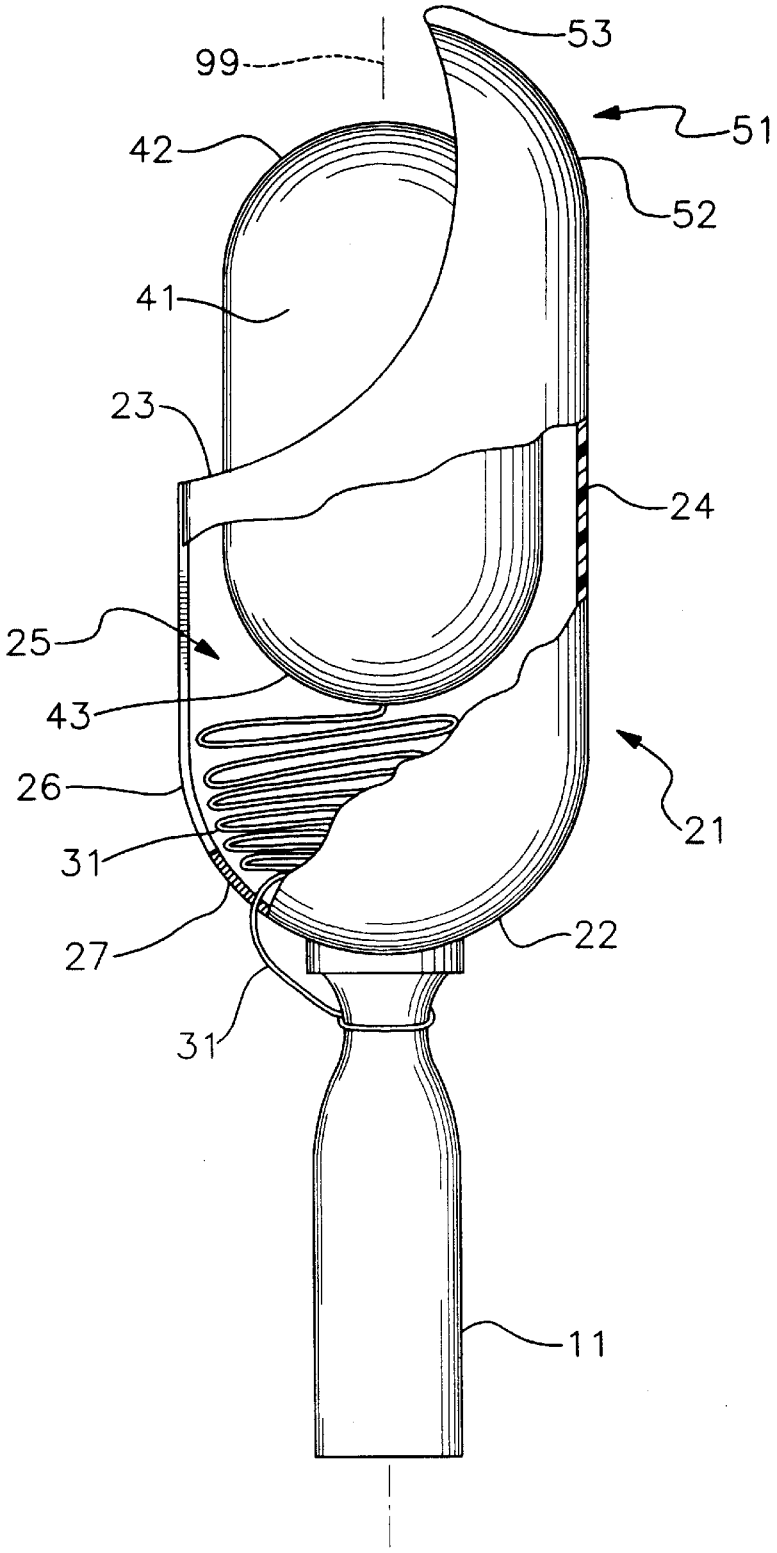
FIG. 2 is a partially exposed side view of the invention showing the float member and line as disposed within the throwing basket prior to use.

As seen in FIGS. 1 and 2, the line throwing device of the invention comprises in general a handle 11, a throwing basket, cage or housing 21, a line member 31 and a float or weight member 41, where the handle 11 is connected to the throwing basket 21 and the line member 31 and float member 41 are disposed within the throwing basket 21.

The handle 11 maybe of multiple shapes or configurations suitable for providing a secure and comfortable grip in the palm of a person's hand, but is preferably of an elongated cylindrical or rod-like shape of generally circular cross-sectional diameter such that the handle 11 fits easily into the palm with the fingers encircling the handle 11, such that the throwing basket 21 is disposed adjacent or a relatively short distance from the hand. The exterior of the handle 11 may be contoured to provide for a better grip or to provide an area of reduced cross-sectional diameter for attachment of the line member 31 in a simple manner which precludes the line member 31 from slipping off the free end of the handle 11, or the handle 11 may be apertured to allow the line member 31 to be passed through and secured. The handle 11 may be solid or hollow, and can be composed of wood, plastic, metal or other material suitable for use in a marine environment.

The throwing basket 21 is preferably coaxially connected to the handle 11 such that the handle 11 and the throwing basket 21 share a common central longitudinal axis 99. The throwing basket 21 comprises a generally elongated tubular or hollow cylindrical wall member 24 defining an interior 25, a closed or lower end 22, to which the handle 11 is attached, and an open or upper end 23, through which the float member 41 and line member 31 are propelled. The throwing basket 21 may be composed of any suitable material for marine use, such as wood, plastic or metal, but is preferably plastic for ease of manufacture. A longitudinally oriented slot 26 is disposed in wall member 24 and extends from the open end 23, such that the upper end of the slot 26 is open, to a point near, adjacent or on the bottom closed end 22. The lower end of the slot 26 is preferably broadened to create a retrieval guide opening 27 of greater width, with the retrieval guide opening 27 allowing for rapid and controlled passage of the line member 31. The minimum width of the slot 26 is greater than the diameter of the line member 31, such that the line member 31 will slide relatively easily into and out of slot 26. It is most preferred that the slot 26 be positioned to the front of the throwing basket 21.

While the open end 23 of throwing basket 21 may be formed as perpendicular to the longitudinal axis, it is preferred that the open end 23 be provided at an angle or in arcuate manner relative to wall member 24, such that the length of the throwing basket is longer in the back than in the front. Most preferably, as seen best in FIG. 2, the open end 23 is provided with a throwing guide or lip member 51 which extends generally upward from the back of the throwing basket wall member 24. Guide member 51 comprises a generally curving wall member 52 which arches inwardly toward the longitudinal axis 99, such that the open end 23 is disposed toward the front of the throwing basket 21 such the direction of travel of the float member 41 when propelled from the throwing basket 21 is angled slightly forward off the longitudinal axis 99. This allows the float member 41 to be propelled with more accuracy, as the float member 41 is more readily retained within the throwing basket 21 during the back swing and forward throwing motion. When the thrower stops the forward motion to propel the float member 41 in the desired direction and at the desired trajectory, inertia causes the float member 41 to continue in the forward arcing direction just long enough for it to clear the forward edge 53 of the throwing guide member 51.

The float member 41, where the terminology is used herein to also represent any weighted object connected to the line member 31 to provide sufficient mass to pull the non-rigid line 31 from the throwing basket 21, is preferably constructed to be generally cylindrical, either solid or hollow, with a rounded forward end 42 and a rounded rear end 43 for aerodynamic efficiency, and may be constructed of any suitable material which will float yet which has sufficient weight and mass to pull the tethered line 31 a relatively long distance through the air when thrown, such as expanded polymer foam or hard plastic. The size and diameter of the float member 41 is such that it can be inserted into the interior 25 of the throwing basket 21 with enough clearance that the float member 41 can be easily propelled from the interior 25, but the clearance should not be so great that the travel path of the float member 21 is not controlled by the throwing basket wall 24 and the guide member 51 during its propulsion. This is important to maintain the accuracy of the invention.

The line member or tether 31 is connected to the rear end of the float member 41, and the line member 31 may comprise any cord, string, rope or extruded line composed of any material having suitable strength and environmental characteristics for use in marine environments and for use in rescue situations. The line member 41 may or may not float. The line member 31 is secured onto either the throwing basket 21 or the handle 11, and preferably the line member 31 is connected to the handle 11 externally to the throwing basket 21, the line member 31 extending through the slot 26 and retrieval guide opening 27 as shown best in FIG. 1. Prior to use, the line member 31 is loosely disposed within the throwing basket interior 25 beneath the float member 41, and may be coiled, folded or randomly distributed. The bulk of the line member 31 maintains the float member 41 in the upper portion of the throwing basket 21 such that its forward end 42 is adjacent the guide member 51 and extends partially through the open end 23.

Figure 3:
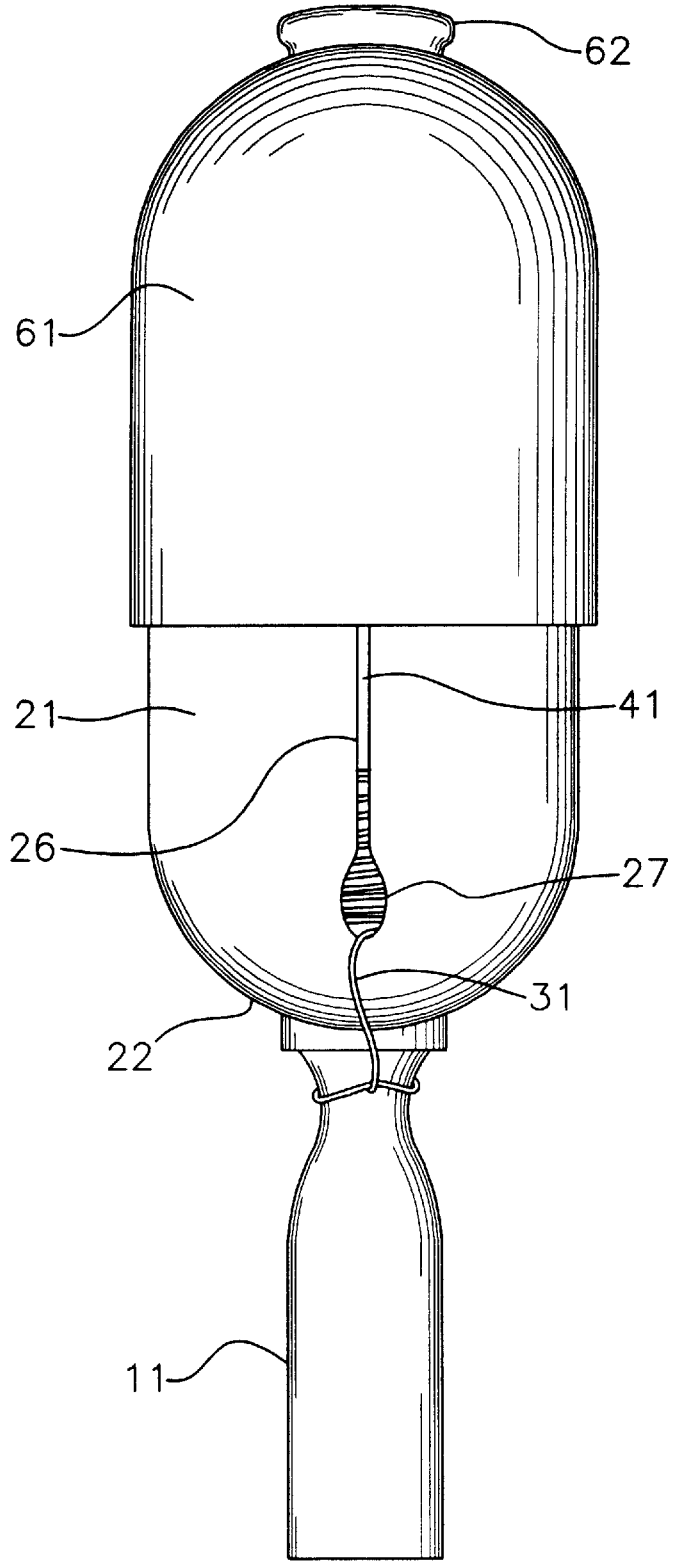
FIG. 3 is a front view of the invention showing the cover positioned on the throwing basket during storage and drainage.

As shown in FIG. 3, the throwing basket 21 is preferably provided with a removable cover or cap member 61 which is configured to fit over the guide member 51 and open end 23 of the throwing basket 21, such that it partially covers slot 26. The cover member 61 may be provided with a grasping knob or member 62 for easier removal from the throwing basket 21. By truncating the cover member 61 such that the lower portion of the slot 26 remains exposed at all times, any water which enters the interior 25 of the throwing basket 21 can drain when the invention is disposed in an upright storage position, and air may circulate into the interior 25 to allow the line member 31 and float member 21 to dry.

To use the line throwing device, the cover member 61 is removed and the thrower grasps the handle 11 with the throwing guide 51 positioned to the rear, bringing the throwing basket first to the rear and then flinging it forward in the desired direction with a generally extended arm, in the same manner as throwing a baseball or football. The forward motion propels the float member 41 from the throwing basket 21 in a controlled manner, with a proper throwing motion resulting in the longitudinal axis 99 of the throwing basket 21 being aimed along the precise directional line and at the desired trajectory when the forward throwing motion is stopped. The walls 24 and guide member 51 provide in combination a controlling means to more accurately propel the float member 21 from the throwing basket 21. As the float member 41 leaves the throwing basket 21, the line member 31 plays out behind the float member 41, the weight of the line member 31 relative to the weight of the float member 21 being such that the line member 31 does not restrict or impede the flight of the float member 21 through the air. In the event that the first throw is not successful, the line 31 is inserted into the slot 26 if the line member 31 has been pulled completely from the throwing basket 21 and is rapidly retrieved by pulling the line 31 through the retrieval guide opening 27 to retract the float member 41 until it is pulled directly into the throwing basket 21, the retrieval guide opening 27 acting to control the line member 31 as it is retrieved such that the user can pull in a long segment of line member 31, then grasp the line member 31 adjacent to the retrieval guide opening 27 to pull in another long segment, etc. The majority of the line member 31 is left outside the throwing basket 21 during subsequent throws. Alternatively, the thrower may retrieve expended line in large increments outside of the throwing basket 21, manually reinserting the float member 41 into the throwing basket 21 for a subsequent throw once the float member 41 has been retrieved. In either method, it is not necessary to replace the line member 31 into the throwing basket 21 prior to making the subsequent throw.

It is contemplated that equivalents and substitutions for certain components set forth above may be obvious to those skilled in the art, and thus the true scope and definition of the invention is to be as set forth in the following claims.

I claim:

1. A line throwing device for propelling a line or a tethered object, the line throwing device comprising:

a handle for gripping the device;

a throwing basket connected to said handle, said throwing basket being generally tubular and comprising a closed end, an open end, a wall member and an interior;

a float member retained within said throwing basket;

a line member, said line member connected to said float member and to said handle, wherein the majority of said line member is retained within said throwing basket;

a slot disposed in said wall member, wherein said slot extends from said throwing basket open end to near said throwing basket closed end, and wherein said line member extends through said slot;

said slot further comprising a retrieval guide opening of greater width than the remainder of said slot, said retrieval guide opening adapted to control said line member during retrieval of said line member;

whereby said float member and said line member are adapted to be propelled from said throwing basket by a rapid forward throwing motion.

2. The device of claim 1, further comprising a guide member joined to said throwing basket at said open end, said guide member comprising a curved wall member extending from said throwing basket wall and which is curved toward the interior of said throwing basket.

3. The device of claim 2, said throwing basket further comprising a longitudinal axis, wherein said handle is connected to said throwing basket on said longitudinal axis, and wherein said curved wall member curves toward said longitudinal axis.

4. The device of claim 3, wherein said float member is generally cylindrical with a rounded forward end and a rounded rear end, and wherein said line member is connected to said float rear end.

5. The device of claim 1, further comprising a removable cover member which encloses said throwing basket open end and partially covers said slot.

6. A line throwing device comprising:

a float member having a generally cylindrical shape with a rounded forward end and a rounded rear end;

a line member connected to said rear end of said float member;

a generally tubular throwing basket having a longitudinal axis and comprising a closed end, a wall member, an open end and a guide member, all defining an interior which receives said float member and said line member, and further comprising a slot longitudinally disposed in said wall member extending from said open end to said closed end, said slot being of sufficient width to allow passage therethrough of said line member, and wherein said guide member comprises a curved wall member extending from said throwing basket wall member at said open end, said curved wall member curving toward said longitudinal axis; and a handle connected to said throwing basket closed end, said line member being connected to said handle through said slot;

whereby said float member and said line member can be propelled from said open end of said throwing basket, and further whereby said float can be retrieved and reinserted into the interior of said throwing basket with the line member disposed externally to said throwing basket for a subsequent propelling of said float member and said line member.

7. The device of claim 6, where said handle has a generally elongated, circular in cross-section configuration and is connected coaxially to said throwing basket.

8. The device of claim 6, further comprising a removable cover member disposed onto said open end of said throwing basket, wherein said cover member does not completely cover said slot.

9. The device of claim 6, wherein said slot further comprises a retrieval guide opening through which said line member is rapidly retrieved, said retrieval guide opening adapted to control said line member during retrieval of said line member.

10. A line throwing device comprising:

a handle;

a throwing basket having an open end and connected to said handle;

a float member temporarily disposed within said throwing basket;

a line member connected to said float member;

a slot extending from said open end of said throwing basket, said slot having a width sufficient to allow passage of said line member therethrough, wherein said slot further comprises a retrieval guide opening of greater width than the remainder of said slot, said retrieval guide opening adapted to control said line member during retrieval of said line member.

11. The device of claim 10, wherein said line member is connected to said handle.

12. The device of claim 10, wherein said slot extends toward said handle.

13. The device of claim 10, further comprising a removable cover member which encloses said open end of said throwing basket and partially covers said slot.

* * * * *